US006065324A

United States Patent [19]

Russell

[11] Patent Number: 6,065,324

[45] Date of Patent: May 23, 2000

[54] ROTARY BENDER DIE

[75] Inventor: Robert L. Russell, Frankfort, Ill.

[73] Assignee: Power Brake Dies, Inc., South Holland, Ill.

[21] Appl. No.: 09/346,755

[22] Filed: Jul. 1, 1999

[51] Int. Cl.[7] ..... B21D 5/04; B21D 37/04

[52] U.S. Cl. ..... 72/387; 72/313

[58] Field of Search ..... 72/313, 387, 388, 72/389.4

[56] References Cited

U.S. PATENT DOCUMENTS

| | | | |
|---|---|---|---|
| 4,002,049 | 1/1977 | Randolph, Sr. | 72/388 |
| 4,181,002 | 1/1980 | Eckhold et al. | 72/387 |
| 4,434,644 | 3/1984 | Gargrave et al. | 72/387 |
| 4,535,619 | 8/1985 | Gargrave | 72/481 |
| 5,341,669 | 8/1994 | Katz | 72/387 |

OTHER PUBLICATIONS

Read Benders, Ready Tools, Inc., Catalog 452B, pp. 1–16, 1984.

*Primary Examiner*—David Jones
*Attorney, Agent, or Firm*—McCaleb, Lucas & Brugman

[57] ABSTRACT

A multi-piece die section for a press brake installed rotary bending tool in which a forming anvil is positioned in a holder in accordance with the thickness of material to be bent so that the rotary bender and press brake operate on the same center line. In one version of the holder a forming anvil is adjustably positioned relative to the center line of the rotary bender and in a second version thereof the forming anvil is precision sized in accordance with the thickness of the work material whereby to eliminate the need for shims and readjustment of press ram stroke as required by the first version.

10 Claims, 8 Drawing Sheets

ROTARY BENDER DIE

This invention is generally related to the art of metal forming and more particularly is directed to an improved novel die holder section cooperative with a rotary bender.

BACKGROUND OF THE INVENTION

For the purpose of better understanding the present invention it is important to recognize prior practice when employing a typical rotary bender and its cooperating die section in a press brake, by way of example.

In the usual set up, a rotary bending tool or bender is attached to the ram of a press brake for movement toward and away from a cooperating forming anvil of a die section for the purpose of folding or bending sheet material between the bender and the anvil. In general such rotary benders are capable of bending sheet material of varying thicknesses. For example, one typical standard size rotary bender to be referred to hereinafter is designed to bend sheet material having a prescribed minimum thickness of 0.010 inches and a maximum thickness of 0.042 inches.

To accomplish such thickness changes, the die section is made up of a base secured to the bed of the press. The base has a forming anvil with which the rotary bender cooperates. A heel plate is movably connected to on side of the base and has a machined face designed to engage an opposing precision ground surface at one end of a saddle member which supports the rotatable rocker of the bending tool. When set up to handle material of the recommended minimum thickness for a particular bender the opposing surfaces of the heel plate and saddle member are engaged and located at a precise dimension from the vertical center line of the rotary bender which is aligned with the center line of the die section and press ram.

When the bender and die section are aligned to handle thicker materials, say at the recommended maximum thickness for the particular size rotary bender noted above, the heel plate surface is disengaged and moved away from the precision ground surface of the rotary bender's saddle. This insures proper material thickness clearance between the bender rocker and an opposing end surface of the forming anvil with which the bender rocker works. In order to maintain proper clearance between the bender rocker and the base forming anvil working edge, it is necessary to add an appropriate shim between the heel plate and the base; the shim being of a selected thickness to accommodate the added material thickness between the rocker and the end face of the forming anvil. Once the shim is in position the heel plate is again locked tightly in place against the shim.

Unfortunately, the addition of the shim between the heel plate and the base of the die section, causes the base and its mounting tang to shift laterally off the center line of the press, as well as out of alignment with the bender unit assembly. This condition is completely unacceptable and can seriously damage both the press and bending tool. Additionally, any parts produced under these operating conditions would likely have inaccurate and inconsistent bends in the finished parts and possibly could endanger the press operator.

According to the above described procedures and practice each and every change in material thickness requires a different shim thickness and complete realignment of the die section in the press.

To accomplish this change the die holder is loosened and moved to a position where both halves of the bending tool are properly aligned in the press even if such alignment means that the forming anvil and the die holder are aligned off the center line of the press. Thereafter, the die holder is re-tightened and rechecked to assure its proper alignment after the tightening procedure.

When one considers that most common press brake die holders are 12 feet long, it is quite apparent how time consuming and expensive this entire procedure can be. When it is further considered that there are as many as 13 different thicknesses of standard gauge sheet steel available between thinnest and thickest gauge and the same number of thicknesses if one is bending galvanized steel, stainless steel, aluminum, brass, etc., the time and expense devoted to proper press alignment under current practice is staggering.

BRIEF SUMMARY OF THE INVENTION

This invention concerns a new and improved die section useful in conjunction with a rotary bender conventionally employed in a press brake and made up of a base, a moveable forming anvil carried by the base, and a replaceable mounted heel piece which is located by means of key and key way means and positively locked in place by mounting means. The mounted bender unit and die section are aligned and maintained on the same vertical center line as the press throughout operating cycles.

Uniquely, the forming anvil is separate from the die section body and is mounted at one corner of the die section body to cooperate with the rotary bender. To accommodate changes in thickness of material to be bent between the rotary bender and the forming anvil, the anvil is movable laterally of the die section body to permit placement of selected shim strips between the die section body and an opposing face of the forming anvil. This simple adjustment for thickness takes place with minimal time and effort and without disturbing the alignment of the rotary bender and die section relative to the center line of the press.

It is a primary object of this invention to provide an improved die section for use with rotary bending tools which eliminates the need to realign the press die holder after a material thickness change.

Another object of this invention is to provide an improved die section as set out in the preceding object which provides for material thickness changes without disturbing the alignment of the bender and die section relative to the center line of the press.

Still another important object of this invention is to provide a novel die section capable of affording multiple benders and die sections positioned along the length of a die rail for simultaneous bending operation of individual benders to form materials of different thicknesses.

It is also an important object of this invention to provide a die section which markedly reduces set-up time, and eliminates the need to disassemble or remove the forming die in order to accomplish material thickness changes.

It is a still further object of this invention to provide an improved die section for use with an associated rotary bender, mounted in a press brake, which promotes economies of production, time, labor and accuracy of product.

Having described this invention, the above and further objects, features and advantages thereof will be recognized by those skilled in the art from the following detailed description of preferred and modified embodiments of the invention illustrated in the accompanying drawings.

IN THE DRAWINGS

DESCRIPTION OF THE PREFERRED EMBODIMENT

Figure 2:
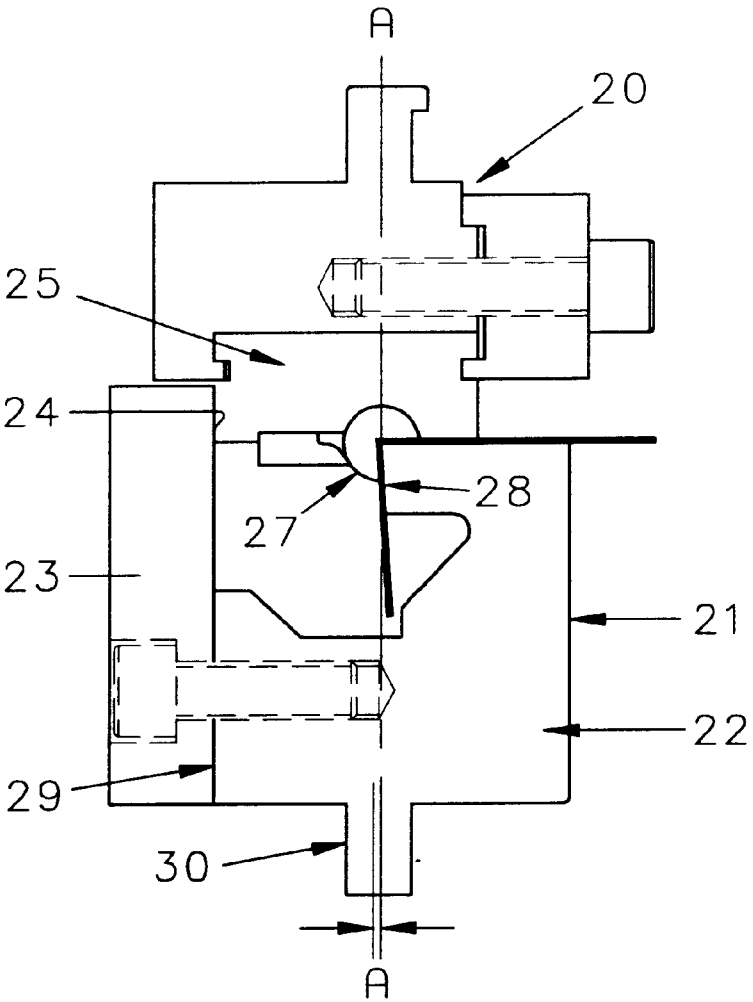
FIG. 2 is another end elevation corresponding to FIG. 1 except for the thickness of the material being treated.
Figure 1:
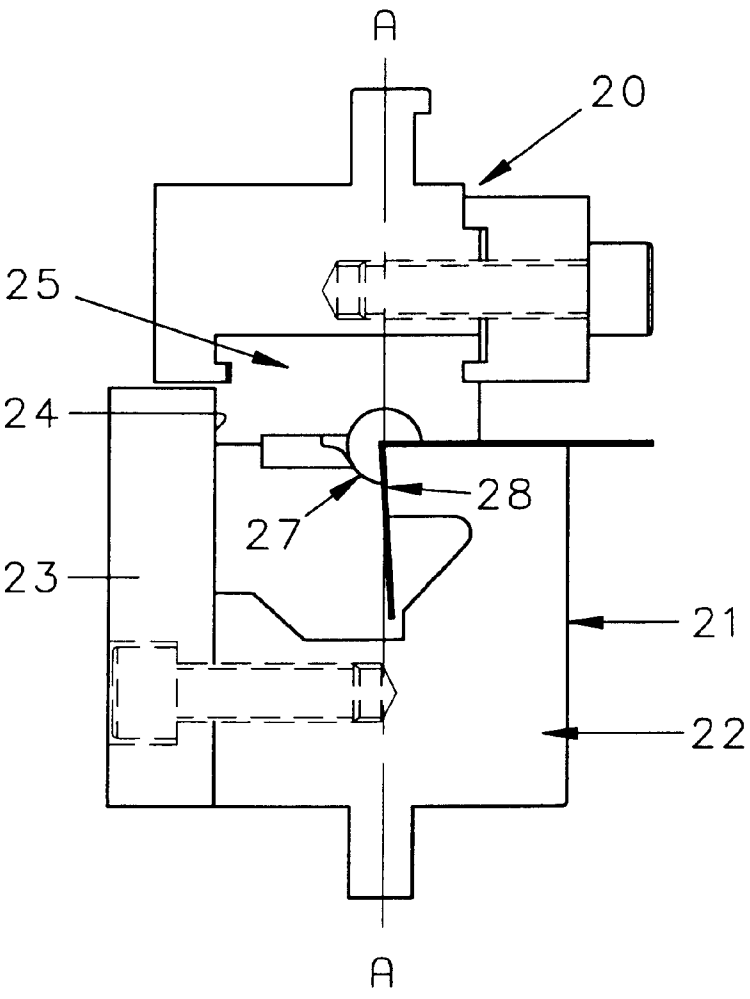
FIG. 1 is an end elevation of a prior art die section and a novel rotary bender holder.

Preliminary to a detailed description of the present invention, initial attention is directed to FIGS. 1 and 2 of the drawings. These figures illustrate the general make up of a rotary bender unit 20 and a lower die unit 21 formed by a base 22 and a heel plate 23.

The particular rotary bender unit 20 shown in the drawings is the subject of my co-pending application Ser. No. 09/291,236, filed Apr. 13, 1999, and appears in this application for the purpose of better understanding the operation and features of the die unit 21 per se. On the other hand, the die unit 21 of FIGS. 1 and 2 is conventional and known in the prior art.

While rotary bender units are of several sizes, each capable of bending sheet materials of different thicknesses, for purposes of the present description a bender size capable of bending thin material (0.010 inches) to thicker material ( 0.042 inches) will serve as an illustrative example.

To this end FIG. 1, shows the bender unit 20 bending thin sheet steel 0.010 inches thick, while FIG. 2 illustrates the same size bender set up to bend thicker material i.e., 0.042 inches thick.

In FIG. 1, the heel plate 23 directly engages a precision ground surface 24 at one end of the bender saddle member 25. Importantly, no shims or other spacers are used between the die base and the heel plate 23 when bending stock at the designated thinness limit of the bender unit, in this case 0.010 inches.

On the other hand, as seen in FIG. 2, when the bender is set up to bend thicker sheet material, such as sheet steel 0.042 inches thick (the highest thickness recommended for the particular size bender unit 20 shown) the heel plate 23 remains directly engaged with the precision ground surface 24 of the bender unit. This insures that the proper material thickness clearance (in this case 0.042 inches) is maintained between the bender's rotatable rocker 27 and the forming die surface 28. In order to maintain this clearance a shim 29 (in this instance 0.032 inches thick) is inserted between heel plate 23 and the opposing face of the die base 22.

The presence of the shim 29 between the heel plate and base causes the entire base 22 and its mounting tang 30 to be displaced 0.032 inches off center with respect to the center line of the press, creating an unacceptable condition as heretofore discussed.

Figure 3:
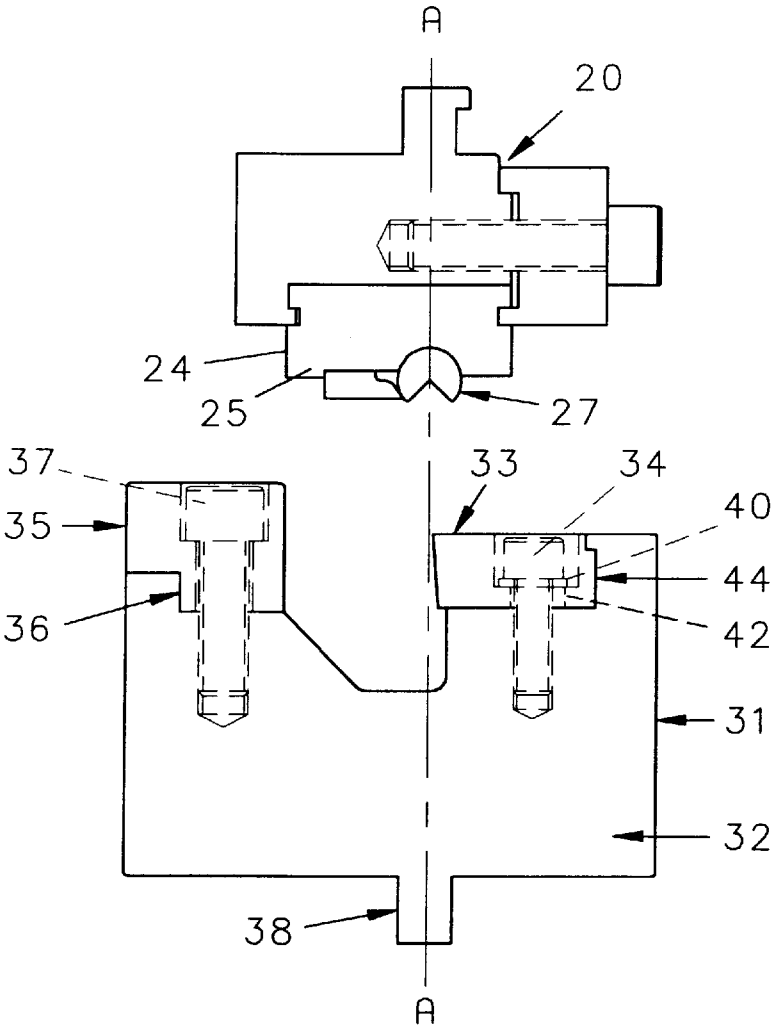
FIG. 3 is an end elevation of the die holder of this invention operationally aligned with the rotary bender of FIGS. 1 and 2, in operating Alignment.

The present invention, shown in FIG. 3, obviates the above noted shortcomings of the die holder unit 21 as will appear from what follows.

As shown in FIG. 3 the bender unit 20 remains unchanged from that shown in FIGS. 1 and 2. However, the lower die unit 31 of this invention comprises a base 32, carrying a separate forming anvil 33, held in place by mounting bolts 34. A separate heel piece 35 is located by key and keyway means 36 or equivalent and held in place by bolts 37.

As indicated, the lower die unit 31 and the upper bender unit 20 are aligned on the same vertical axis A—A. The mounting tang 38, which serves to hold and align the base 32 in the die holder of the press, is positioned so that unit 31 is perfectly aligned and centered in the press.

Figure 4:
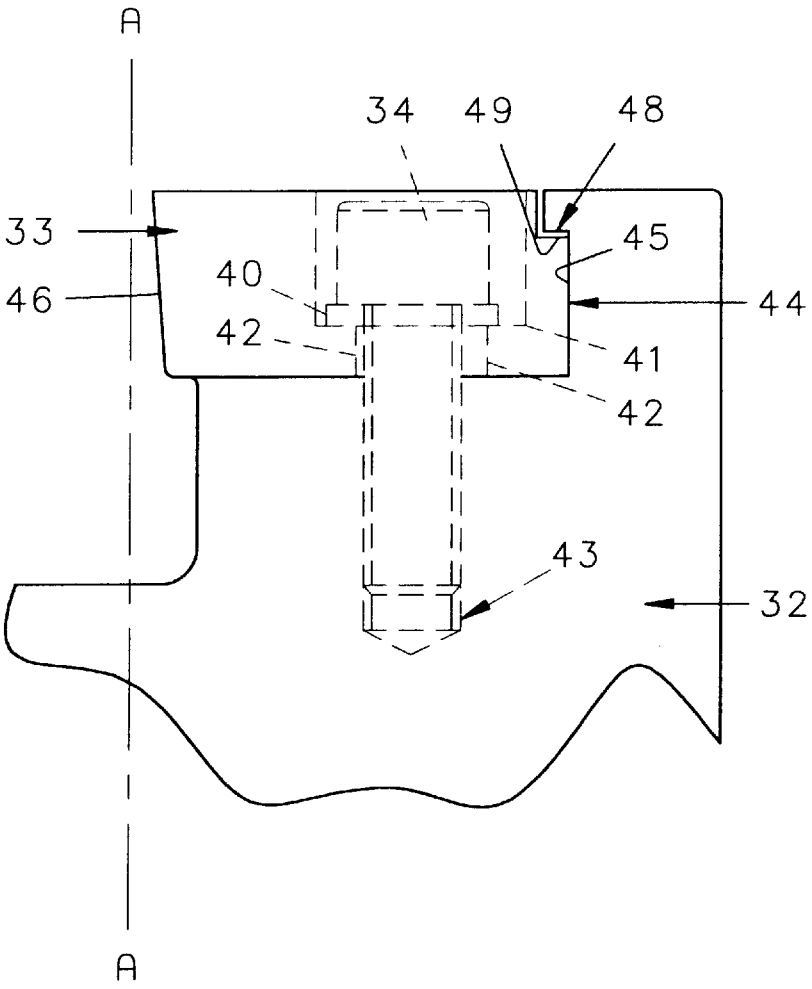
FIG. 4 is a partial enlarged end elevation of the forming anvil and adjustable holding means therefor, illustrated in FIG. 3.

Referring now to the enlarged partial view, FIG. 4 shows the adjustable forming anvil 33 with its spaced mounting bolts 34 and a broken away portion of base 32.

It will be noted that relatively thick spacers 40 are disposed under the heads of the bolts 34 to provide increased holding surfaces in the oversized counter bores 41. The bolt receptive bores 42 and the counter bores 41 in the forming die are purposely oversize while the mounting bolts 34 are intentionally off-center of the threaded bolt receptive bores 42. This arrangement permits the forming anvil 33 to be moved laterally and repositioned relative to the center line of the base 32 and bender unit 20. As the anvil 33 is moved in the direction of arrow U, a gap will open between surface 44 of base 32 and its mating end surface 45 of the forming anvil 33. Into this gap appropriate size, off the shelf, shim stock is inserted to provide necessary clearance between the forming edge 46 of the anvil member 33 and the rotary bender rocker (see FIG. 7).

Figure 8:
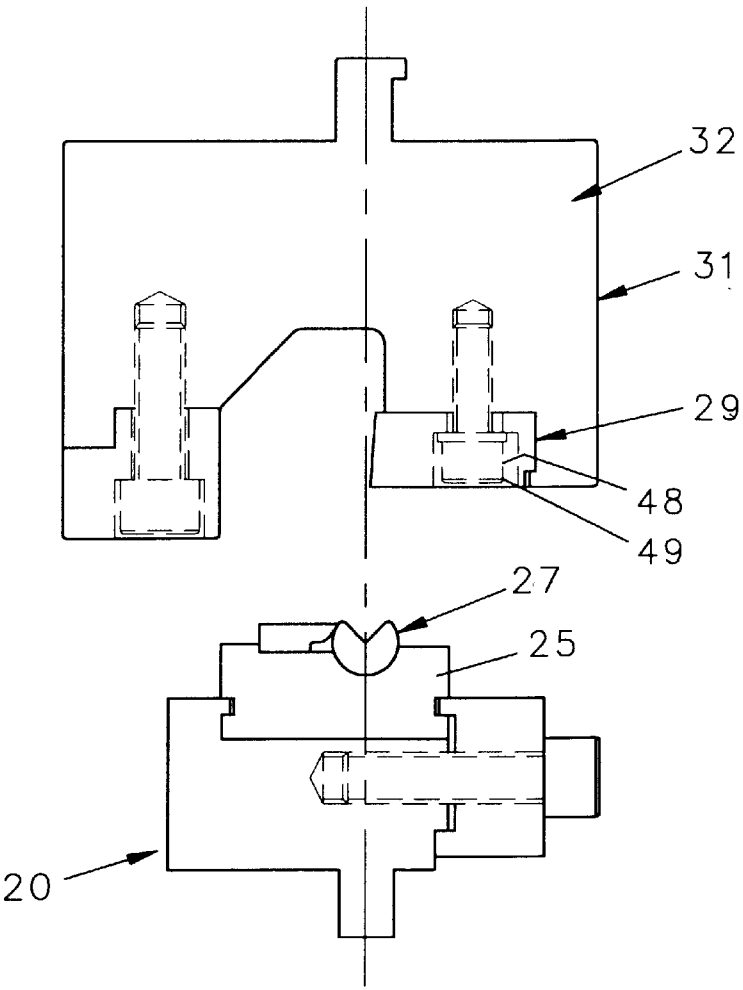
FIG. 8 is an end elevation of the rotary bender and die section of FIG. 6 aligned on a common vertical center line for operation in inverted positions.

It also will be noted that overlapping key and keyway surfaces 48 and 49 have sufficient clearance to permit easy movement of the forming anvil as required while at the same time the overhanging surface 48 holds any shim in place in the event the bender and die units are used in inverted positions (see FIG. 8).

Figure 5:
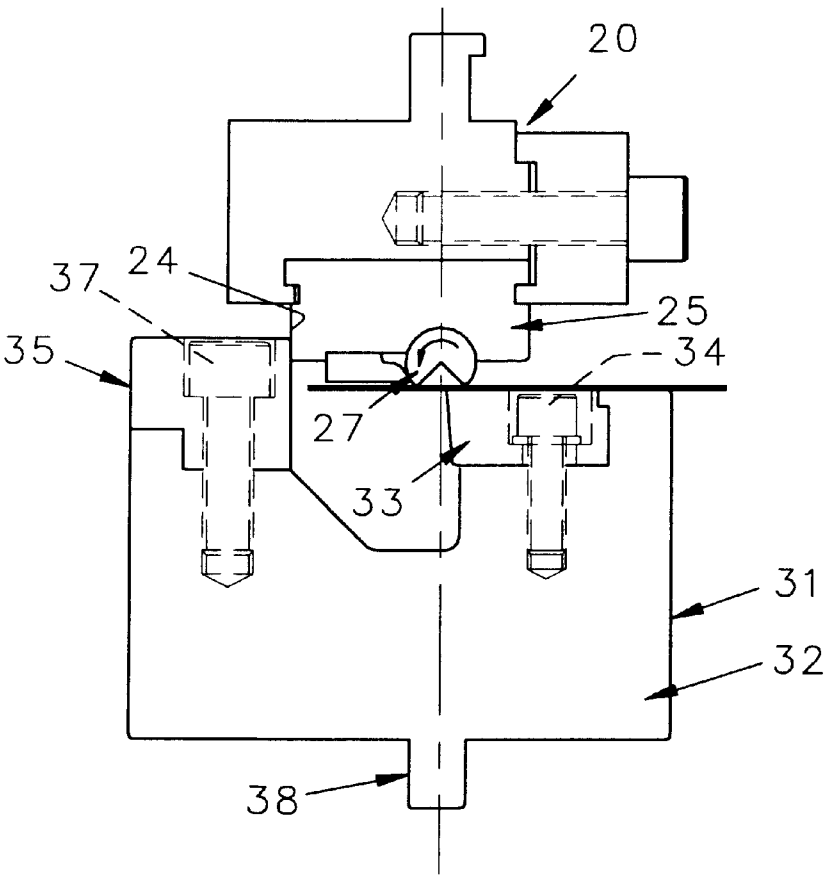
FIG. 5 is an end elevation of the rotary bender and die section shown in FIG. 3, illustrating the bender engaged with sheet material preparatory to bending operation.

In FIG. 5, the bender unit 20 is shown making initial contact with material to be bent. It is clear that the precision ground end surface 24 of the bender saddle 25 is engaged by the opposing surface of the heel piece 35 prior to the act of bending the material. Because of this early contact, proper alignment of the bending unit is assured.

Figure 6:
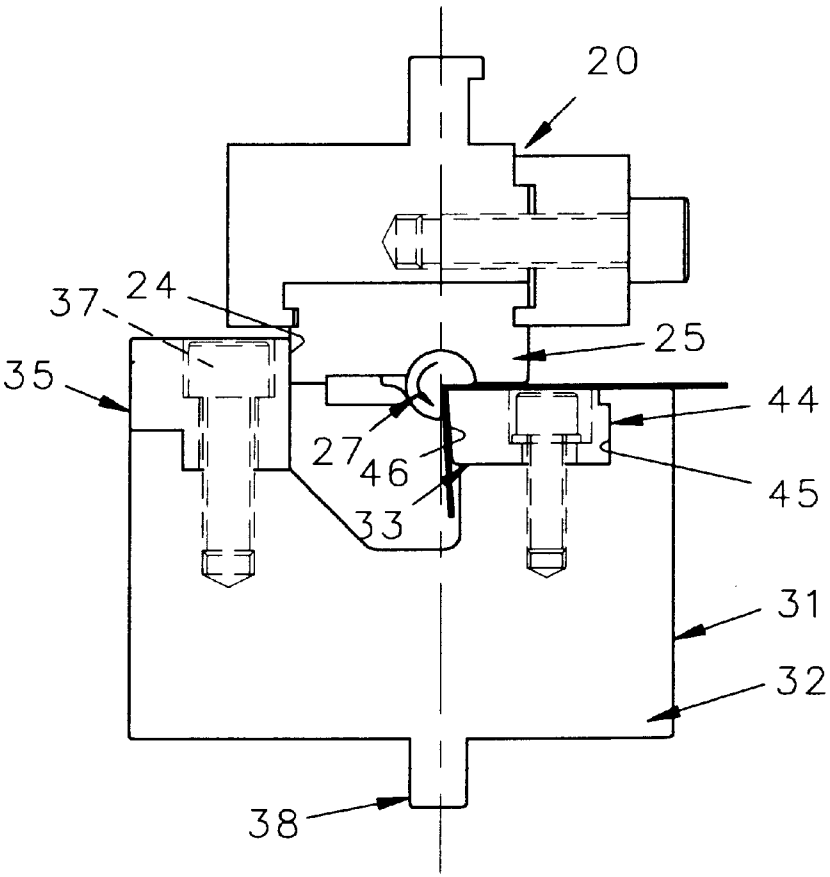
FIG. 6 is an end elevation of the rotary bender and die section of FIG. 5 illustrating the position of parts at completion of bending heavy gauge material.

FIG. 6 shows the bender tool 20 of FIG. 5 at the bottom of the press stroke after bending thicker material (0.042 inches) for this particular size bender. It will be noted that the forming anvil 33 is firmly against surface 45 of the base, and that there is no shim between anvil 33 and surface 45. It also will be noted that the entire rotary bending tool 20 is on the same center line as the die unit 31 and therefore there is no need for lateral adjustment of the die holder in the press.

Figure 7:
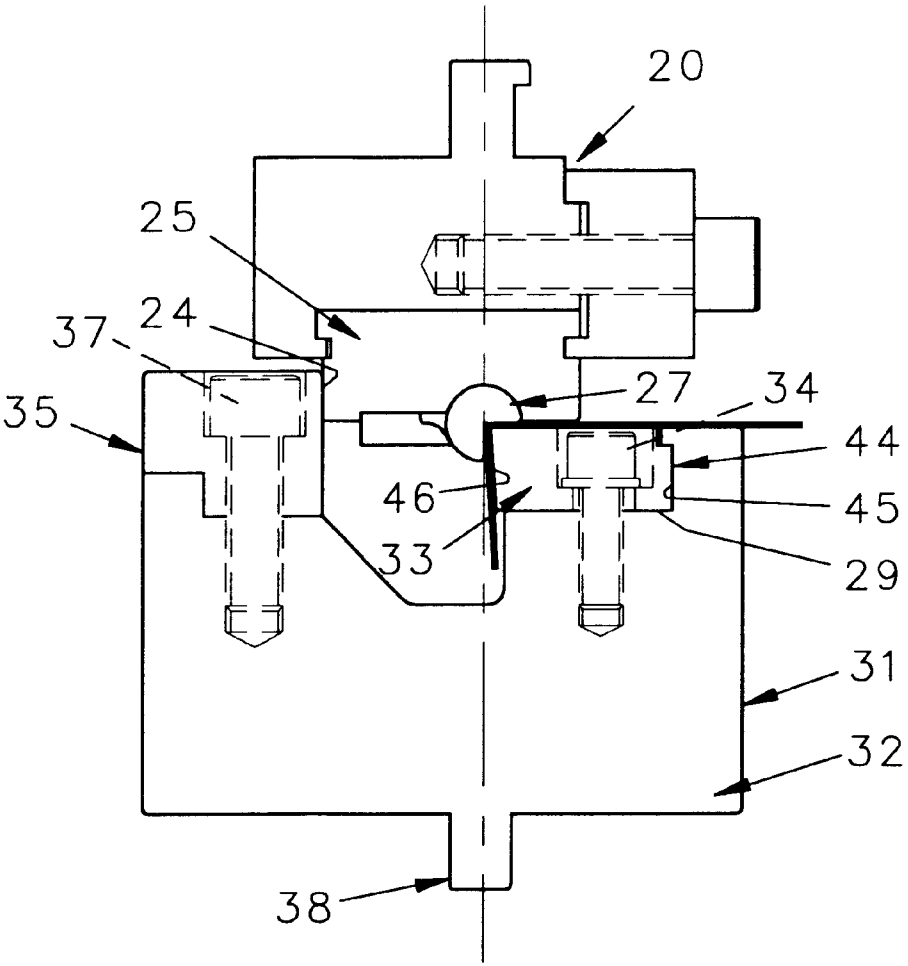
FIG. 7 is an end elevation of the rotary bender and die section of FIG. 6, showing the relationship of parts at completion of bending light gauge materials.

FIG. 7 demonstrates the merits of the present invention. As illustrated therein, the bending tool is shown after bending the thinnest material (i.e., 0.010 inches) for which the particular illustrative bender unit 20 is rated. Note, that a shim 29 has been inserted between surfaces 44 and 45, which serves to locate the forming edge 46 of anvil 33 at the proper distance from the center of the rotary bender 27. This insures proper tool and die clearance needed to produce a good quality product. As shown the entire tool is in the same position that it was when bending the heaviest material illustrated in FIG. 6, without any realignment of the press or the die holder required.

In FIG. 8, an alternate use of the bending tool of FIGS. 3–7 is shown, i.e., realignment of the bending tool and lower die unit in inverted positions. This inverted alignment brings into play the overhanging key defining surfaces 48 and 49 wherein the surface 48 engages any shim between the forming anvil and surface 44 of the base 32. For instance, rather than several people holding a shim in position while trying to tighten the forming anvil 33 against the shim, one person now can successfully install (even an elongated shim) by simply sliding it between the forming anvil and surface 44.

Figure 9:
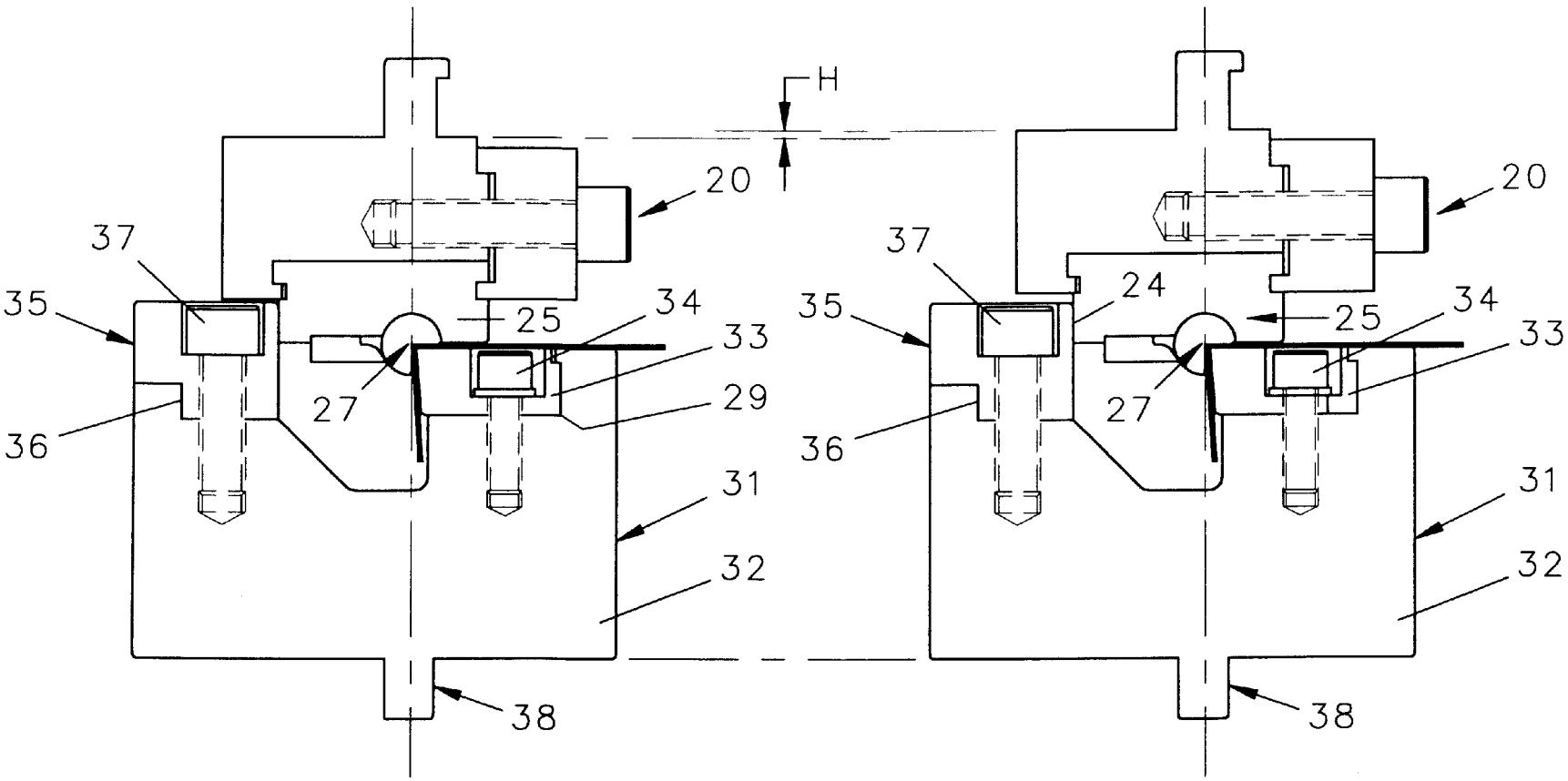
FIG. 9 shows end elevations of the tool and die section of FIGS. 6 and 7 bending thin and thick sheet metal, respectively.
Figure 10:
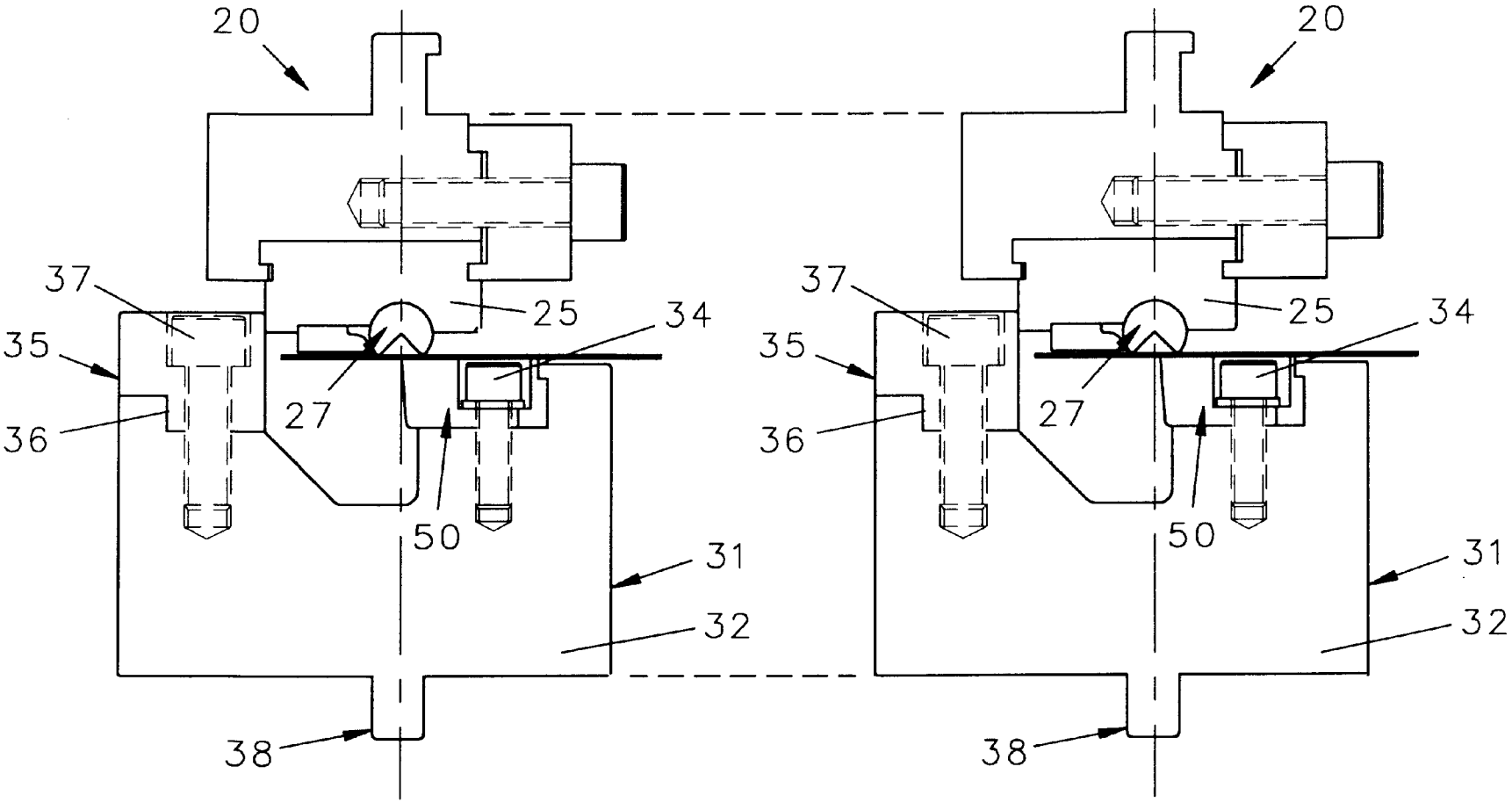
FIG. 10 shows end elevations of two like tool and die sections arranged to operate in the same press, at the same time using the same press stroke.

In FIGS. 9–10 of the drawings features of a modified form of the present invention are set forth as will appear presently.

FIG. 9 illustrates side-by-side like end elevations of the aforedescribed rotary bender unit 20 and the improved die holder 31 of this invention; both having a standard forming anvil 33. In the die holder on the left side of this figure, which is the same as seen in FIG. 7, the bender unit 20 is shown at the bottom of the press stroke at the completion of bending the thinnest sheet material for which the bender is rated; in this illustrated case 0.010 inches. The die holder on the right side of FIG. 9, is the same as seen in FIG. 6, having completed bending the thickest material (0.042 inches) for which the bender rated. In both instances the same anvil 33 is employed.

Although the center line of the two die holders and dies of FIG. 9 are on the center line of the press, due to the 0.032 inch shim 29 previously described, the bending height of the two FIG. 9 die sets, when closed in the press, is different by 0.032 inches, as indicated at H. In most cases this height differential poses no insurmountable problem since the height of the press stroke can be readily adjusted by the touch of a control button on the press. However, there are occasions where it is advantageous to operate a press with materials of two or more different thicknesses at the same time while using the same press stroke.

For comparison FIG. 10 shows the same two die sets or sections as they are set up to run together in the same press at the same time, using the same press stroke or height setting according to this modified version of the present invention.

This improvement over the FIG. 9 embodiment is brought about by replacing the standard anvil 33 with a precision forming anvil 50. The anvils 50 differ from the standard anvils 33 in that they are tailored to operate with a specific single size or thickness of material to be formed. Thus anvils 50 may be made with a specific width to eliminate the necessity of shims betweens the anvil and body of the holder 32, as seen in FIGS. 7 and 9.

In similar fashion, a precision anvil 50 may be made of specific thickness to accommodate to the particular thickness of the material being formed. This feature eliminates the need to adjust the press height or stroke. Thus with these modified precision anvils, multiple thickness materials can be formed simultaneously in the same press by separate rotary benders and die anvils without the need for shims or press stroke adjustments.

Thus the basic concept of the above described tools may be carried out, particularly employing precision anvils, if multiple metal thickness forming is to be carried out in the same press. Consequently small and large rotary benders may be used for simultaneously forming materials of different thickness, if precision anvils such as 50 and 51 are employed (see FIG. 11).

From the foregoing it is believed that those familiar with the art will readily recognize and appreciate the novel advancements in the art provided by the present invention and further will understand that while this invention has been described in association with preferred and modified embodiments shown in the drawings, such are nevertheless susceptible to change, modification and substitution of equivalents without departing from the spirit and scope of the invention which is intended to be unlimited by the foregoing except as may appear in the following appended claims.

The embodiments of the invention in which an exclusive property or privilege is claimed are defined as follows:

1. A die section for cooperation with a press actuated rotary bender, comprising:

a rigid base having means for detachable connection with a press;

a forming anvil detachably mounted on said base to present a working edge cooperable with a rotary bender mounted in a saddle;

a heel piece at one side of said base engageable with said saddle for positively positioning said bender so that a center line thereof consistently coincides with a center line of said press; and said forming anvil being operatively aligned with said center line of said rotary bender and said press to effect bending of a work piece on said center line regardless of material thickness.

2. The die section of claim 1, wherein said forming anvil is adustably positioned laterally of said center line in accordance with the thickness of material to be formed by and between said bender and forming die whereby material engaged by said bender is formed on said center line.

3. The die section set out in claim 2, wherein said heel piece is prevented from moving laterally of said base and said forming die.

4. The die section of claim 3, wherein said heel piece is aligned on said base so that a face thereof positively positions said bender whereby to maintain said bender aligned with said center line of said press throughout the bending of said work piece.

5. The die section of claim 4, wherein said heel piece is located laterally opposite said forming anvil and is prevented from moving laterally away from said anvil.

6. The die section of claim 2, wherein movement of said anvil toward said center line creates a space between said base and an opposing face of said anvil; and a shim mounted in said space to compensate for said movement of said anvil.

7. The die section of claim 6, wherein said forming anvil is mounted in a recess cut in said base, and said anvil and base are interlinked by key and keyway means to limit vertical movement of said anvil and prevent loss of said shim from said space in an inverted or upside down position of said die section.

8. The die section of claim 1, wherein said base has a cut away area receptive of said forming anvil, and said forming anvil is precision formed to fill said area and position said working edge thereof operationally aligned with said center line of said rotary bender and press.

9. The die section of claim 8, wherein said forming anvil is precision formed for each thickness of material to be formed; said anvil compensating for the thickness of said material to properly position said working edge relative to said center line and regulate press stroke.

10. The die section of claim 1, wherein multiple die sections of different sizes and capacities are mounted in a press to cooperate with multiple rotary benders of different sizes and capacities whereby materials of different thicknesses are formed simultaneous by while maintaining the same center line and press stroke to form said materials.

* * * * *

UNITED STATES PATENT AND TRADEMARK OFFICE

CERTIFICATE OF CORRECTION

PATENT NO. : 6,065,324
DATED : May 23, 2000
INVENTOR(S) : Robert L. Russell

Figure 11:
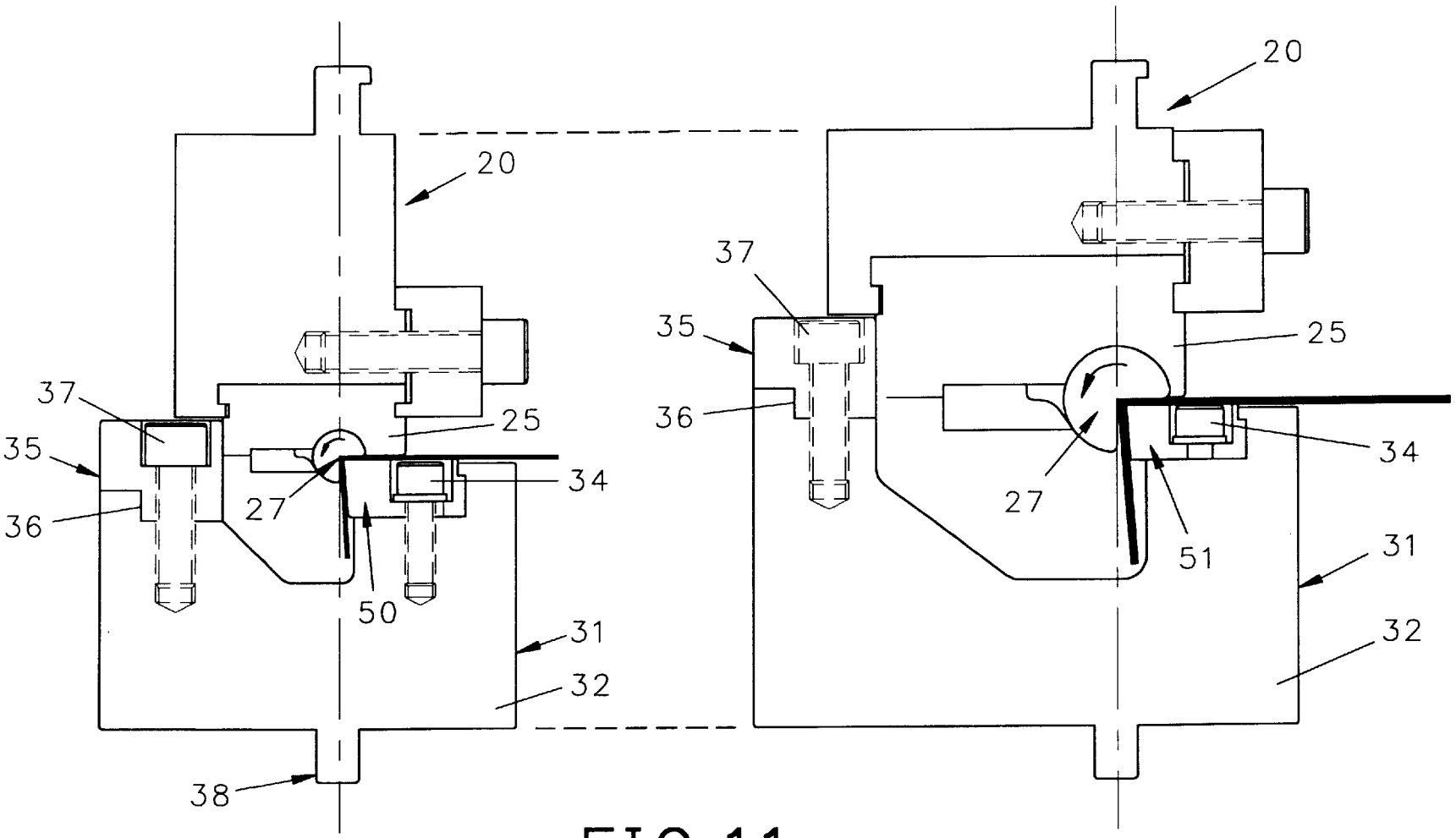
FIG. 11 sets forth comparative end elevations of tool and die sections set up to bend metal sheet of distinctly different thicknesses and employing rotary benders of distinctly different size and bending capacity.
Figure 8:
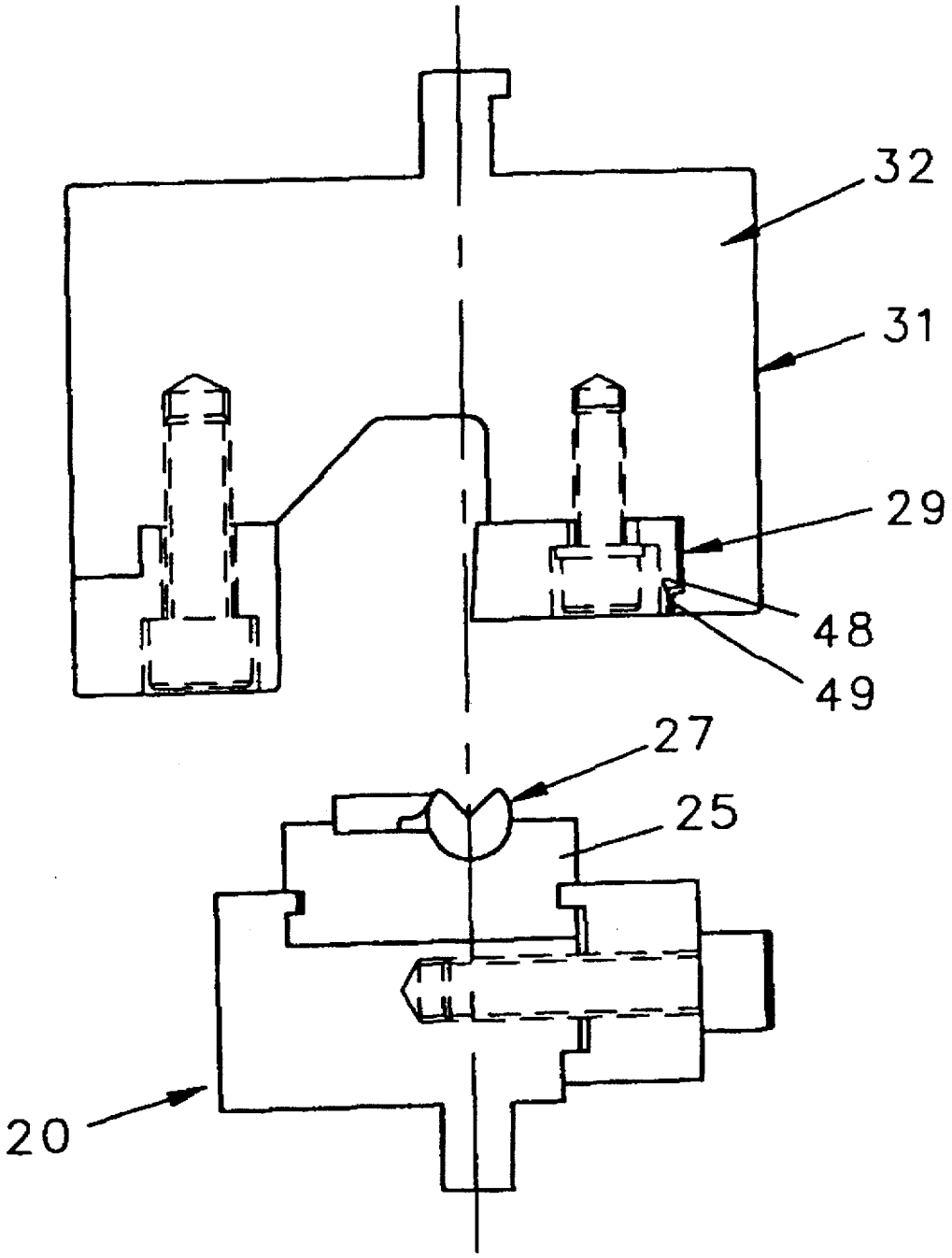
Figure 11:
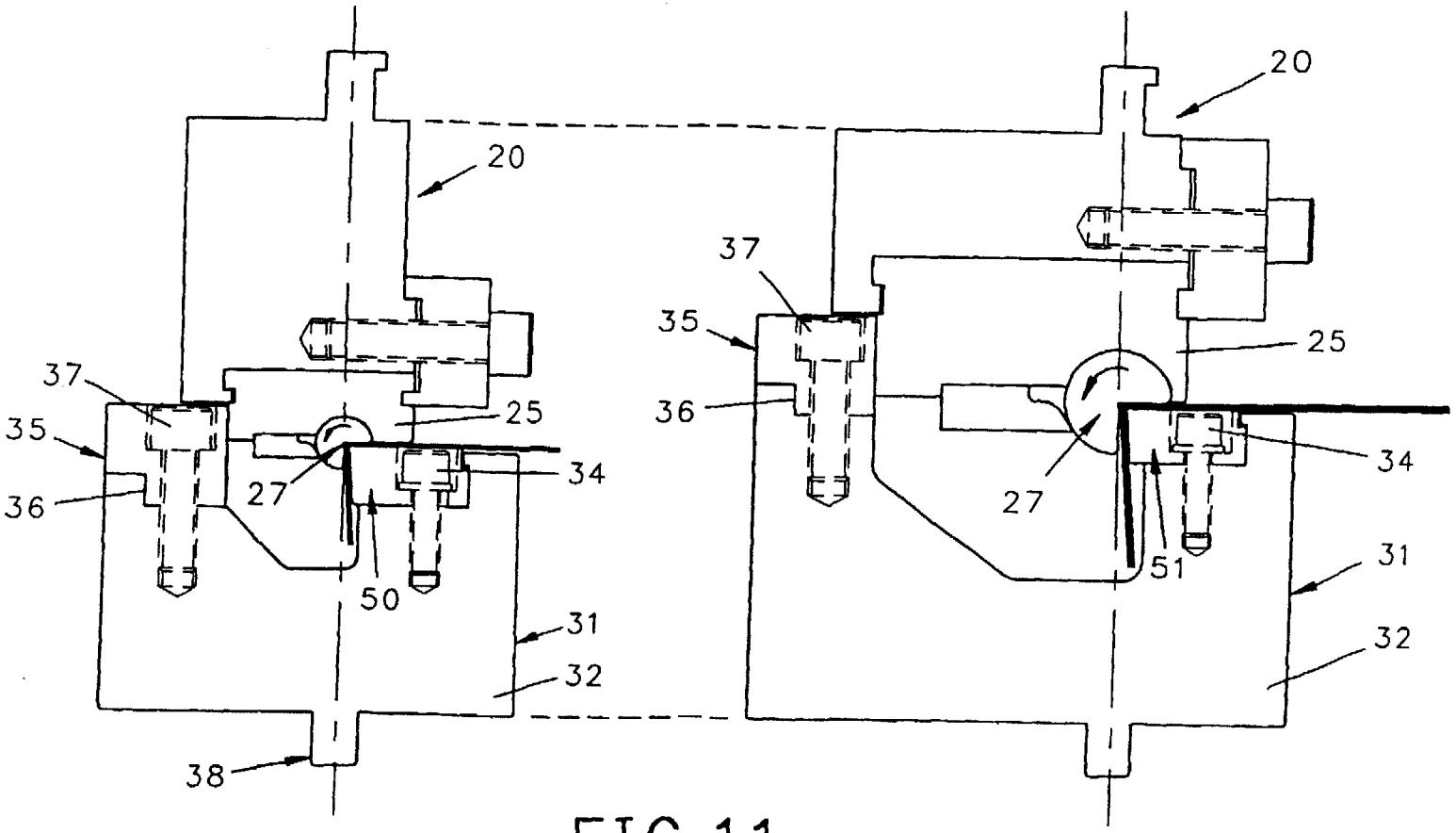

It is certified that error appears in the above-identified patent and that said Letters Patent is hereby corrected as shown below:

The sheets of drawings consisting of figure 8 and figure 11 should be deleted to appear as per attached sheets.

Column 3,
Line 5, delete "Alignment", and insert -- alignment --;

Column 4,
Line 36, delete "threaded";

Column 8,
Line 5, delete "simultaneous by" and insert -- simultaneously --.

Signed and Sealed this

Fourth Day of September, 2001

Nicholas P. Godici

*Attest:*

*Attesting Officer*

NICHOLAS P. GODICI
*Acting Director of the United States Patent and Trademark Office*